US008686982B2

(12) United States Patent
Ryu et al.

(10) Patent No.: US 8,686,982 B2
(45) Date of Patent: Apr. 1, 2014

(54) CURRENT GENERATOR AND ORGANIC LIGHT EMITTING DISPLAY USING THE SAME

(75) Inventors: Do-Hyung Ryu, Yongin (KR); Do-Ik Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 299 days.

(21) Appl. No.: 12/723,372

(22) Filed: Mar. 12, 2010

(65) Prior Publication Data

US 2011/0012819 A1 Jan. 20, 2011

(30) Foreign Application Priority Data

Jul. 14, 2009 (KR) ..... 10-2009-0063933

(51) Int. Cl.
*G09G 5/00* (2006.01)

(52) U.S. Cl.
USPC ..... 345/211; 345/82

(58) Field of Classification Search
USPC ..... 345/36, 39, 44–46, 74.1–83, 211–213; 315/169.1–169.4; 313/463
See application file for complete search history.

(56) References Cited

U.S. PATENT DOCUMENTS

| | | | | |
|---|---|---|---|---|
| 2002/0175909 | A1* | 11/2002 | Matsumoto | 345/211 |
| 2003/0090446 | A1 | 5/2003 | Tagawa et al. | |
| 2003/0117353 | A1* | 6/2003 | Moon | 345/87 |
| 2005/0151065 | A1 | 7/2005 | Min | |
| 2005/0225515 | A1* | 10/2005 | Tsuchida et al. | 345/76 |
| 2009/0051628 | A1* | 2/2009 | Kwon | 345/77 |

FOREIGN PATENT DOCUMENTS

| | | | |
|---|---|---|---|
| JP | 2001-042828 | | 2/2001 |
| JP | 2003-150107 | | 5/2003 |
| JP | 2003-234624 | | 8/2003 |
| JP | 2004-006533 | | 1/2004 |
| JP | 2006-251515 | | 9/2006 |
| JP | 2009-053647 | | 3/2009 |
| KR | 10-2006-0112993 | A | 11/2006 |
| KR | 10-0846969 | B1 | 7/2008 |
| KR | 10-0846970 | B1 | 7/2008 |
| KR | 100846970 | B1 | 7/2008 |
| KR | 10-2009-0011638 | A | 2/2009 |
| KR | 1020090020190 | A | 2/2009 |
| TW | 200537406 | A | 11/2005 |

OTHER PUBLICATIONS

KIPO Office action dated Jan. 26, 2011, issued in priority Korean application No. 10-2009-0063933, 2 pps.

(Continued)

*Primary Examiner* — Chanh Nguyen
*Assistant Examiner* — Ram Mistry
(74) *Attorney, Agent, or Firm* — Christie, Parker & Hale, LLP

(57) ABSTRACT

A current generator for supplying or sinking current to/from pixels. The current generator includes a variable power source, a first amplifier having a first input terminal coupled to the variable power source, a sensing resistor coupled between an output terminal of the first amplifier and an external terminal of the current generator, and a second amplifier having a first input terminal and a second input terminal coupled to respective ends of the sensing resistor and an output terminal coupled to a second input terminal of the first amplifier.

12 Claims, 4 Drawing Sheets

(56) References Cited

OTHER PUBLICATIONS

Japanese Office action dated Jan. 31, 2012 issued in Japanese Patent Application No. 2009-246957, which claims priority to corresponding Korean priority application No. 10-2009-0063933, 2 pages.

JPO Office action dated Feb. 26, 2013, for corresponding Japanese Patent application 2009-246957, (2 pages).

Taiwan Office action dated May 21, 2013, with English translation, corresponding to Taiwanese Patent application 099112132, (11 pages).

* cited by examiner

CURRENT GENERATOR AND ORGANIC LIGHT EMITTING DISPLAY USING THE SAME

CROSS-REFERENCE TO RELATED APPLICATION

This application claims priority to and the benefit of Korean Patent Application No. 10-2009-0063933, filed on Jul. 14, 2009, in the Korean Intellectual Property Office, the entire content of which is incorporated herein by reference.

BACKGROUND

1. Field

An embodiment of the present invention relates to a current generator and an organic light emitting display using the same.

2. Description of the Related Art

Recently, various flat panel displays (FPD) with reduced weight and volume in comparison to cathode ray tube (CRT) type displays have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

FIG. 1 is a schematic circuit diagram illustrating a pixel of a conventional organic light emitting display.

Referring to FIG. 1, a pixel 4 of the conventional organic light emitting display includes an organic light emitting diode OLED and a pixel circuit 2 coupled to a data line Dm and a scan line Sn to control the OLED.

The anode electrode of the OLED is coupled to the pixel circuit 2, and the cathode electrode of the OLED is coupled to a second power source ELVSS. The OLED emits light with a brightness corresponding to the current supplied from the pixel circuit 2.

The pixel circuit 2 controls the amount of current supplied to the OLED to correspond to a data signal supplied to the data line Dm when a scan signal is supplied to the scan line Sn.

Here, the pixel circuit 2 includes a second transistor M2 coupled between a first power source ELVDD and the OLED, a first transistor M1 coupled to the second transistor M2, the data line Dm, and the scan line Sn, and a storage capacitor Cst coupled between the gate electrode and the first electrode of the second transistor M2.

The gate electrode of the first transistor M1 is coupled to the scan line Sn, and its first electrode is coupled to the data line Dm. Then, the second electrode of the first transistor M1 is coupled to one terminal of the storage capacitor Cst.

Here, the first electrode is set as one of a source electrode and a drain electrode, and the second electrode is set as a different electrode from the first electrode. For example, when the first electrode is set as the source electrode, the second electrode is set as the drain electrode. The first transistor M1 coupled to the scan line Sn and the data line Dm is turned on when a scan signal is supplied from the scan line Sn to supply a data signal supplied from the data line Dm to the storage capacitor Cst. Here, the storage capacitor Cst is charged with a voltage corresponding to the data signal.

The gate electrode of the second transistor M2 is coupled to one terminal of the storage capacitor Cst, and its first electrode is coupled to the other terminal of the storage capacitor Cst and the first power source ELVDD. Then, the second electrode of the second transistor M2 is coupled to the anode electrode of the OLED.

The second transistor M2 controls the amount of current supplied from the first power source ELVDD to the second power source ELVSS via the OLED to correspond to the voltage value stored in the storage capacitor Cst. Here, the OLED generates light corresponding to the amount of the current supplied from the second transistor M2.

However, the above-described conventional organic light emitting display cannot display an image with desired brightness due to a change in efficiency in accordance with deterioration of the OLED.

As time passes, the OLED deteriorates so that light generated by the OLED gradually has lower brightness corresponding to the same data signal. In addition, in the conventional art, due to non-uniformity in the threshold voltage/mobility of the driving transistor M2 included in each of the pixels 4, an image with uniform brightness may not be displayed.

SUMMARY

Accordingly, embodiments of the present invention are directed toward a current generator capable of sinking or supplying current and an organic light emitting display using the same.

According to an embodiment of the present invention, there is provided a current generator including a variable power source, a first amplifier having a first input terminal coupled to the variable power source, a sensing resistor coupled between an output terminal of the first amplifier and an external terminal of the current generator, and a second amplifier having a first input terminal and a second input terminal coupled to respective ends of the sensing resistor and an output terminal coupled to a second input terminal of the first amplifier.

The variable power source may be configured to vary its output to a positive or negative voltage to supply a current to the external terminal via the sensing resistor or to sink a current from the external terminal. The first input terminals may be positive input terminals, and the second input terminals may be negative input terminals. The first input terminal of the second amplifier may be coupled between the sensing resistor and the output terminal of the first amplifier, and the second input terminal of the second amplifier may be coupled between the sensing resistor and the external terminal. The current generator may further include a first resistor coupled between the second input terminal of the first amplifier and the output terminal of the second amplifier and a first capacitor coupled between the second input terminal of the first amplifier and the output terminal of the first amplifier.

According to an embodiment of the present invention, there is provided an organic light emitting display including a pixel, a current generator for supplying a first current to the pixel or for sinking a second current from the pixel, an analog-to-digital converter (ADC) for converting a first voltage applied to the ADC when the first current is supplied via an organic light emitting diode (OLED) included in the pixel into a first digital value and for converting a second voltage applied to the ADC when the second current sinks via a driving transistor included in the pixel into a second digital value, a memory for storing the first digital value and the second digital value, a converting circuit for converting input data into corrected data in accordance with the first digital value and the second digital value stored in the memory, and a data driver for generating a data signal in accordance with the corrected data and for supplying the data signal to the pixel. The current generator includes a variable power source, a first amplifier having a first input terminal coupled to the variable power source, a sensing resistor coupled between a node and the output terminal of the first amplifier, the node being between the analog-to-digital converter and the pixel, and a second amplifier having a first input terminal and a second input terminal coupled to respective ends of the sensing resistor and an output terminal coupled to a second input terminal of the first amplifier.

The corrected data may be set to compensate for a deterioration of the OLED and a threshold voltage and mobility of the driving transistor. The variable power source may be configured to vary its output to a positive or negative voltage in order to supply the first current to the pixel via the sensing resistor or to sink the second current from the pixel. The first input terminals may be positive input terminals, and the second input terminals may be negative input terminals. The first input terminal of the second amplifier may be coupled between the sensing resistor and the output terminal of the first amplifier and the second input terminal of the second amplifier may be coupled between the sensing resistor and the node. The organic light emitting display may further include a first resistor coupled between the second input terminal of the first amplifier and the output terminal of the second amplifier and a first capacitor coupled between the second input terminal of the first amplifier and the output terminal of the first amplifier. The organic light emitting display may further include a first switching element provided in each channel and positioned between the data driver and the pixel and a second switching element provided in said each channel and positioned between the node and the pixel.

In the current generator according to the embodiments of the present invention and the organic light emitting display using the same, since current may be supplied or sunk using one current generator, a circuit may be simplified. In addition, when the current generator according to the embodiments of the present invention is used, manufacturing cost may be reduced.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
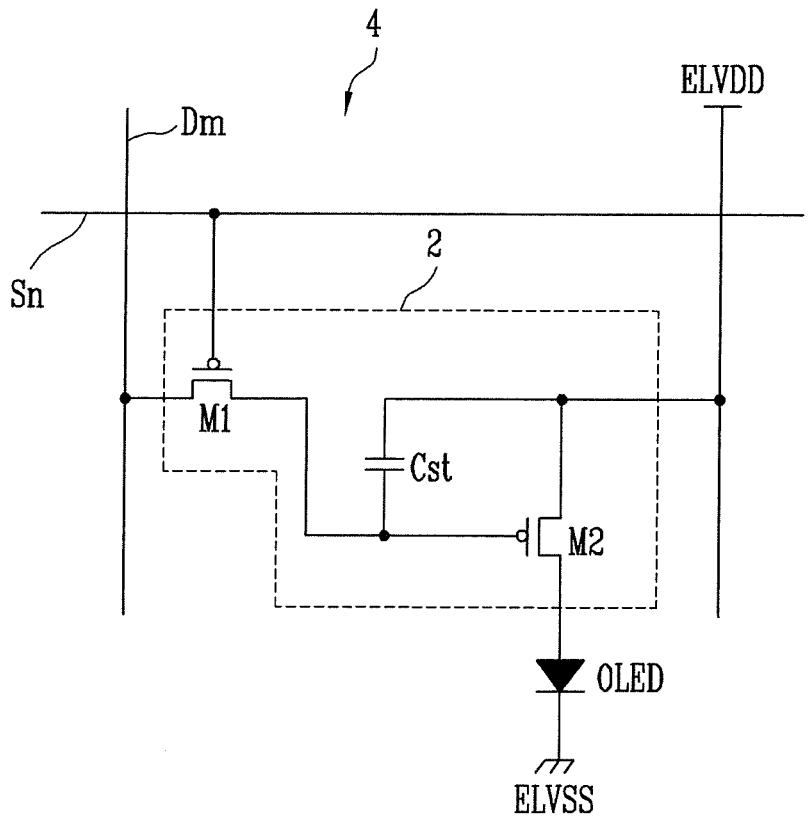
FIG. 1 (PRIOR ART)
FIG. 1 is a schematic circuit diagram illustrating a conventional pixel.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the invention are omitted for clarity. Also, like reference numerals refer to like elements throughout.

Hereinafter, the exemplary embodiments will be described in detail with reference to the accompanying drawings of FIGS. 2 to 7.

Figure 2:
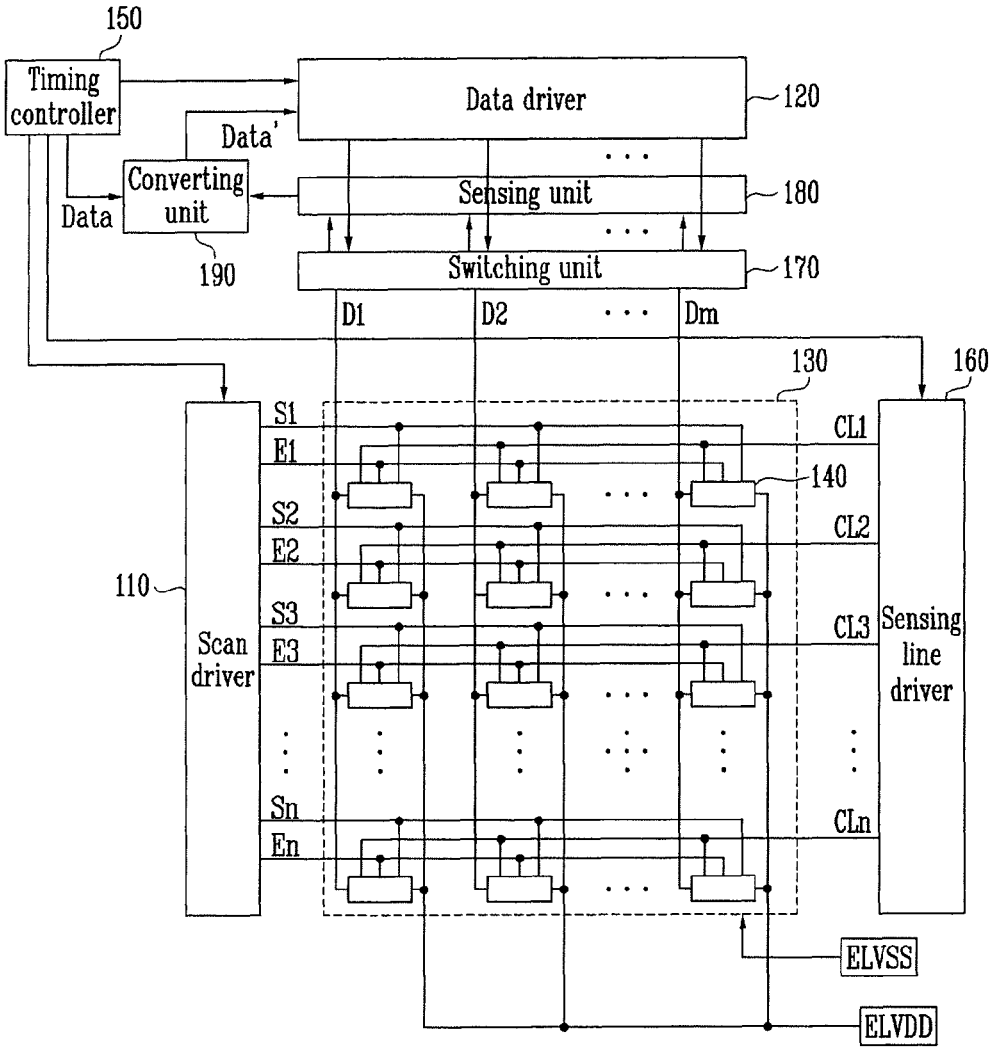
FIG. 2 is a schematic view illustrating an organic light emitting display according to an embodiment of the present invention.

FIG. 2 is a schematic view illustrating an organic light emitting display according to an embodiment of the present invention.

Referring to FIG. 2, the organic light emitting display according to the embodiment of the present invention includes a display unit 130 including pixels 140 coupled to scan lines S1 to Sn, emission control lines E1 to En, sensing lines CL1 to CLn, and data lines D1 to Dm, a scan driver 110 for driving the scan lines S1 to Sn and the emission control lines E1 to En, a sensing line driver 160 for driving the sensing lines CL1 to CLn, a data driver 120 for driving the data lines D1 to Dm, and a timing controller 150 for controlling the scan driver 110, the data driver 120, and the sensing line driver 160.

In addition, the organic light emitting display according to the embodiment of the present invention further includes a sensing unit 180 for extracting information on the deterioration of organic light emitting diodes (OLED) included in the pixels 140 and information on the threshold voltage and mobility of a driving transistor, a switching unit 170 for selectively coupling the sensing unit 180 and the data driver 120 to the data lines D1 to Dm, and a converting unit 190 for storing the information sensed by the sensing unit 180 and for converting input data so as to display an image with uniform brightness regardless of the deterioration of the OLEDs and the threshold voltage and mobility of the driving transistor using the sensed information.

The display unit 130 includes the pixels 140 positioned at regions defined by crossings of the scan lines S1 to Sn, the emission control lines E1 to En, and the data lines D1 to Dm. The pixels 140 receive power from a first power source ELVDD and a second power source ELVSS from the outside. The pixels 140 control the amount of the current supplied from the first power source ELVDD to the second power source ELVSS via the OLEDs to correspond to data signals. Then, light with brightness corresponding to the data signals is generated by the OLEDs.

The scan driver 110 supplies scan signals to the scan lines S1 to Sn by the control of the timing controller 150. In addition, the scan driver 110 supplies emission control signals to the emission control lines E1 to En by the control of the timing controller 150.

The sensing line driver 160 supplies sensing signals to the sensing lines CL1 to CLn by the control of the timing controller 150.

The data driver 120 supplies the data signals to the data lines D1 to Dm by the control of the timing controller 150.

The switching unit 170 selectively couples the sensing unit 180 and the data driver 120 to the data lines D1 to Dm. Therefore, the switching unit 170 includes a pair of switching elements coupled to each of the data lines D1 to Dm (that is, in each channel).

The sensing unit 180 extracts information on the deterioration of the OLEDs included in the pixels 140 and supplies the extracted deterioration information to the converting unit 190. In addition, the sensing unit 180 extracts information on the threshold voltage and mobility of the driving transistor, which is included in each of the pixels 140, and supplies the extracted information on the threshold voltage and mobility of the driving transistor to the converting unit 190. Therefore, the sensing unit 180 includes a current generator coupled to each of the data lines D1 to Dm (that is, in each channel).

Here, the information on the deterioration of the OLEDs may be extracted in a first non-display period after power from a power source is applied to the organic light emitting display before an image is displayed. That is, the information on the deterioration of the OLEDs may be extracted whenever power from the power source is applied to the organic light emitting display.

On the other hand, the information on the threshold voltage and mobility of the driving transistor may be extracted in a second non-display period after power from the power source is applied to the organic light emitting display before the image is displayed and may be extracted before the organic light emitting display is provided as a product so that the information on the threshold voltage and mobility may be provided as previously set information when the product is delivered. That is, the information on the threshold voltage and mobility of the driving transistor may be extracted whenever power from the power source is applied to the organic light emitting display, or the extraction result is previously stored before delivering the product so that, whenever power from the power source is applied, the information on the threshold voltage and mobility is not extracted but the previously stored information may be used.

The converting unit 190 stores the deterioration information and the threshold voltage and mobility information that are supplied from the sensing unit 180. Here, the converting unit 190 stores the information on the deterioration of the OLEDs included in the pixels 140 and the information on the threshold voltage and mobility of the driving transistor. Therefore, the converting unit 190 includes a memory and a converting circuit for converting input data Data from the timing controller into corrected data Data' so that an image with uniform brightness may be displayed regardless of the deterioration of the OLEDs and the threshold voltage and mobility of the driving transistor using the information stored in the memory.

The timing controller 150 controls the data driver 120, the scan driver 110, and the sensing line driver 160.

In addition, the timing controller 150 receives the data Data from the outside and outputs it to the converting unit 190 which converts the data Data into corrected data Data' to compensate for the deterioration of the OLEDs and the threshold voltage and mobility of the driving transistor. The corrected data Data' is supplied to the data driver 120. Then, the data driver 120 generates the data signals using the corrected data Data' and supplies the generated data signals to the pixels 140.

Figure 3:
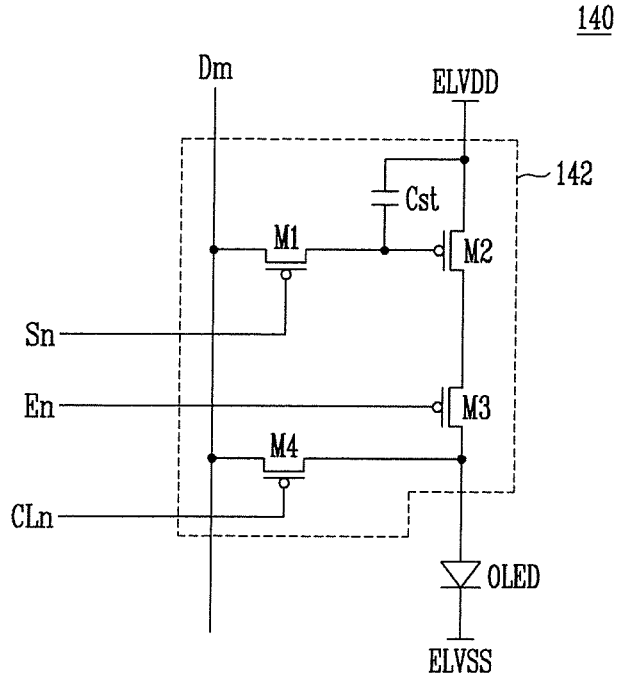
FIG. 3 is a schematic circuit diagram illustrating the pixel of FIG. 2.

FIG. 3 illustrates an embodiment of the pixel 140 of FIG. 2. For the sake of convenience, the pixel 140 coupled to the m-th data line Dm and the n-th scan line Sn will be illustrated.

Referring to FIG. 3, the pixel 140 according to the embodiment of the present invention includes an OLED and a pixel circuit 142 for supplying current to the OLED.

The anode electrode of the OLED is coupled to the pixel circuit 142, and the cathode electrode of the OLED is coupled to the second power source ELVSS. The OLED generates light with a brightness (e.g., a predetermined brightness) that corresponds to the current supplied from the pixel circuit 142.

The pixel circuit 142 receives the data signal supplied to the data line Dm when a scan signal is supplied to the scan line Sn. In addition, the pixel circuit 142 provides the information on the deterioration of the OLED or the information on the threshold voltage and mobility of the driving transistor (that is, the second transistor M2) to the sensing unit 180 when a sensing signal is supplied to the sensing line CLn. In FIG. 3, the pixel circuit 142 includes four transistors M1 to M4 and a storage capacitor Cst.

The gate electrode of the first transistor M1 is coupled to the scan line Sn, and the first electrode of the first transistor M1 is coupled to the data line Dm. The second electrode of the first transistor M1 is coupled to a first terminal of the storage capacitor Cst. The first transistor M1 is turned on when the scan signal is supplied to the scan line Sn. Here, the scan signal is supplied in a period where the information on the threshold voltage and mobility of the second transistor M2 is sensed and in a period where the data signal is stored in the storage capacitor Cst.

The gate electrode of the second transistor M2 is coupled to the first terminal of the storage capacitor Cst, and the first electrode of the second transistor M2 is coupled to a second terminal of the storage capacitor Cst and the first power source ELVDD. The second transistor M2 controls the amount of current that flows from the first power source ELVDD to the second power source ELVSS via the OLED to correspond to the voltage value stored in the storage capacitor Cst. Here, the OLED generates light corresponding to the amount of current supplied from the second transistor M2.

The gate electrode of the third transistor M3 is coupled to the emission control line En, and the first electrode of the third transistor M3 is coupled to the second electrode of the second transistor M2. The second electrode of the third transistor M3 is coupled to the OLED. The third transistor M3 is turned off when an emission control signal is supplied to the emission control line En and is turned on when the emission control signal is not supplied. Here, the emission control signal is supplied in a period where the voltage corresponding to the data signal is charged in the storage capacitor Cst and in a period where the information on the deterioration of the OLED is sensed.

The gate electrode of the fourth transistor M4 is coupled to the sensing line CLn, and the first electrode of the fourth transistor M4 is coupled to the second electrode of the third transistor M3. In addition, the second electrode of the fourth transistor M4 is coupled to the data line Dm. The fourth transistor M4 is turned on when the sensing signal is supplied to the sensing line CLn and is turned off in the other case. Here, the sensing signal is supplied in a period where the information on the deterioration of the OLED is sensed and in a period where the information on the threshold voltage and mobility of the second transistor M2 is sensed.

Figure 4:
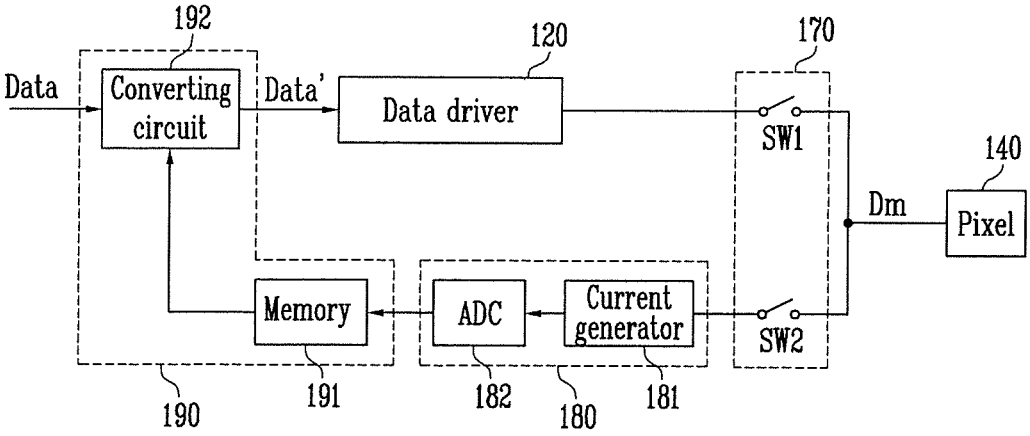
FIG. 4 is a view illustrating the switching unit, the sensing unit, and the converting unit of FIG. 2 in more detail.

FIG. 4 is a view illustrating the switching unit 170, the sensing unit 180, and the converting unit 190 of FIG. 2. In FIG. 4, for the sake of convenience, the pixel 140 coupled to the m-th data line Dm will be illustrated.

Referring to FIG. 4, a pair of switching elements SW1 and SW2 are provided in each channel of the switching unit 170. A current generator 181 and an analog-to-digital converter (hereinafter, referred to as ADC) 182 are provided in each channel of the sensing unit 180. Here, a plurality of channels may share one ADC or all of the channels may share one ADC. The converting unit 190 includes a memory 191 and a converting circuit 192.

The first switching element SW1 of the switching unit 170 is positioned between the data driver 120 and the data line Dm. The first switching element SW1 is turned on when the data signal is supplied through the data driver 120. That is, the first switching element SW1 maintains a turn-on state in a period where the organic light emitting display displays an image (e.g., a predetermined image).

The second switching element SW2 of the switching unit 170 is positioned between the sensing unit 180 and the data line Dm. The second switching element SW2 is turned on while the information on the deterioration of the OLED or the information on the threshold voltage and mobility of the second transistor M2 is sensed for each of the pixels 140 of the display unit 130 through the sensing unit 180.

Here, the second switching element SW2 maintains the turn-on state in the non-display time after power from the power source is applied to the organic light emitting display before the image is displayed or in the non-display period before the product is delivered.

In one embodiment, when the information on the deterioration of the OLEDs is sensed, the deterioration information may be sensed in the first non-display period after power from the power source is applied to the organic light emitting display before the image is displayed. That is, the information on the deterioration of the OLEDs may be sensed whenever power from the power source is applied to the organic light emitting display.

On the other hand, when the information on the mobility and threshold voltage of the driving transistor is sensed, the deterioration information may be sensed in the second non-display period after power from the power source is applied to the organic light emitting display before the image is displayed and may be sensed before the organic light emitting display is delivered as the product.

The current source 181 supplies current to the pixel 140 to sense the information on the deterioration of the OLED or sinks current from the pixel 140 to sense the information on the mobility and threshold voltage of the driving transistor.

Figure 5:
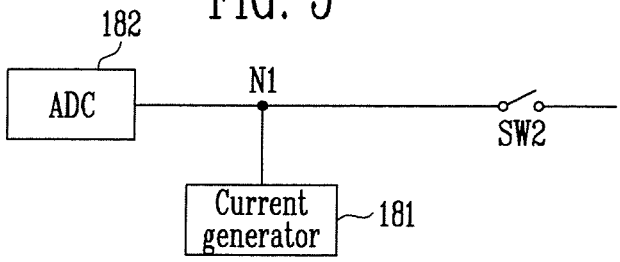
FIG. 5 is a view illustrating a coupling relationship of a current generator of FIG. 4.

As illustrated in FIG. 5, the current generator 181 is coupled to a first node N1 between the second switch SW2 and the ADC 182. The current generator 181 supplies a first current or sinks a second current.

When the first current is supplied to the pixel 140, a predetermined voltage (a first voltage) is generated in the data line Dm, and the generated voltage is supplied to the ADC 182. The first current is supplied via the OLED included in the pixel 140. Therefore, the information on the deterioration of the OLED is included in the first voltage.

As the OLED deteriorates, the resistance value of the OLED changes. Therefore, the voltage value of the first voltage changes to correspond to the deterioration of the OLED so that the information on the deterioration of the OLED may be extracted.

On the other hand, the current value of the first current is set to vary so that a predetermined voltage may be applied within a predetermined time. For example, the first current may be set to the current value of a current flowing through the OLED when the pixel 140 emits light with the maximum brightness.

When the second current is sunk from the pixel 140, a predetermined voltage (a second voltage) is generated in the data line Dm, and the generated voltage is supplied to the ADC 182. The second current is supplied via the second transistor M2 included in the pixel 140. Therefore, the information on the threshold voltage and mobility of the second transistor M2 is included in the second voltage. On the other hand, the current value of the second current is set so that the information on the threshold voltage and mobility of the driving transistor may be stably extracted. For example, the current value of the second current may be set as the same current value of the first current.

The ADC 182 converts the first voltage into a first digital value and converts the second voltage into a second digital value to supply the first digital value and the second digital value to the converting unit 190.

The converting unit 190 includes a memory 191 and a converting circuit 192.

The memory 191 stores the first digital value and the second digital value that are supplied from the ADC 182. Here, the memory 191 stores the information on the threshold voltage and mobility of the second transistor M2 of each of the pixels 140 included in the display unit 130 and the information on the deterioration of the OLEDs.

The converting circuit 192 converts the input data Data received from the timing controller 150 into the corrected data Data' so that an image with uniform brightness may be displayed regardless of the deterioration of the OLED and the threshold voltage and mobility of the driving transistor M2 using the first digital value and the second digital value that are stored in the memory 191.

The data driver 120 generates the data signal using the corrected data Data' and supplies the generated data signal to the pixel 140.

Figure 6:
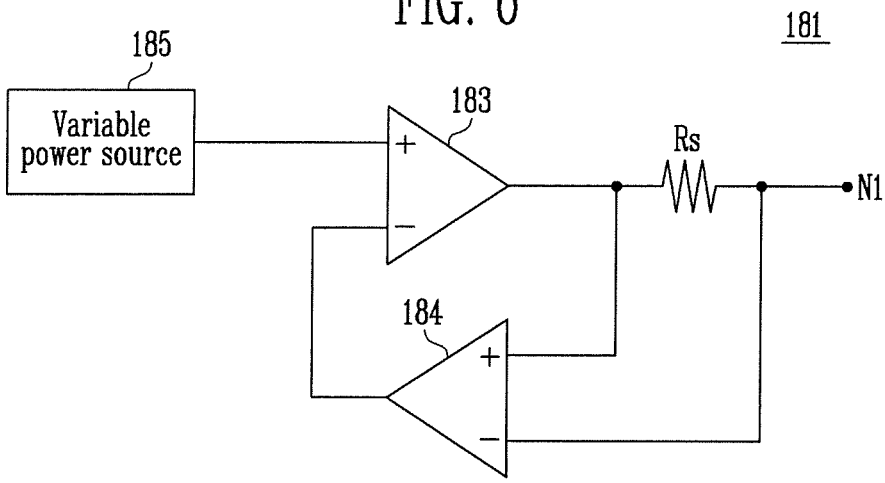
FIG. 6 is a view illustrating an embodiment of the current generator of FIG. 4.

FIG. 6 illustrates the current generator 181 of FIG. 4 in more detail according to an embodiment of the present invention.

Referring to FIG. 6, the current generator 181 according to the embodiment of the present invention includes a variable power source 185, a first amplifier 183, a second amplifier 184, and a sensing resistor Rs.

The output of the variable power source 185 that varies to positive polarity and negative polarity may be varied to various voltages by a user.

The first input terminal (+) (the positive input terminal) of the first amplifier 183 is coupled to the variable power source 183, and the output terminal of the first amplifier 183 is coupled to the sensing resistor Rs.

The sensing resistor Rs is coupled between the output terminal of the first amplifier 183 and the first node N1 (or an external terminal). A voltage corresponding to the current supplied from the first amplifier 183 is generated across the sensing resistor Rs.

The first input terminal (+) and the second input terminal (−) (the negative input terminal) of the second amplifier 184 are coupled to respective ends of the sensing resistor Rs. In FIG. 6, the first input terminal (+) of the second amplifier 184 is coupled between the output terminal of the first amplifier 183 and the sensing resistor Rs, and the second input terminal (−) of the second amplifier 184 is coupled between the sensing resistor Rs and the first node N1. Further, the output terminal of the second amplifier 184 is coupled to the second input terminal (−) of the first amplifier 183. The second amplifier 184 supplies the voltage across the sensing resistor Rs to the second input terminal (−) of the first amplifier 183.

Operation processes of the current generator 181 of FIG. 6 will be described in more detail below. First, a positive voltage is applied from the variable power source 185 to the first input terminal (+) of the first amplifier 183. Here, the first amplifier 183 controls its output voltage (or an output current) so that its first input terminal (+) and its second input terminal (−) are set to have equal potential (the same voltage). Therefore, when the gain of the second amplifier 184 is set as "1", the voltage across the sensing resistor Rs changes until the voltage across the sensing resistor Rs becomes almost the same as the voltage of the variable power source 185. In this case, the current that flows in a period where the voltage across the sensing resistor Rs changes is supplied to the first node N1. That is, when the voltage of the variable power source 185 is set as a positive voltage, a corresponding current is supplied to the first node N1.

In addition, when a negative voltage is applied from the variable power source 185 to the first input terminal (+) of the first amplifier 183, the first amplifier 183 controls its output voltage (or the output current) so that its first input terminal (+) and its second input terminal (−) are set to have equal potential (the same voltage). In this case, a corresponding (or predetermined) current sinks from the first node N1 in a period where the voltage across the sensing resistor Rs changes. Here, the current that flows to the first node N1 is determined by Equation 1.

$$I_{N1} = Vin/(G \times Rs) \quad \text{EQUATION 1}$$

wherein, Vin represents the output voltage of the variable power source 185 and G represents the gain of the second amplifier 184. Here, the gain G and the resistance the sensing resistor Rs are fixed. The current that flows to the first node N1 is determined by the variable power source 185.

As described above, the current generator 181 of an embodiment of the present invention may supply current or may sink current while controlling the voltage of the variable power source 185. In addition, the current generator 181 may control the voltage of the variable power source 185 to freely control the amount of current.

Figure 7:
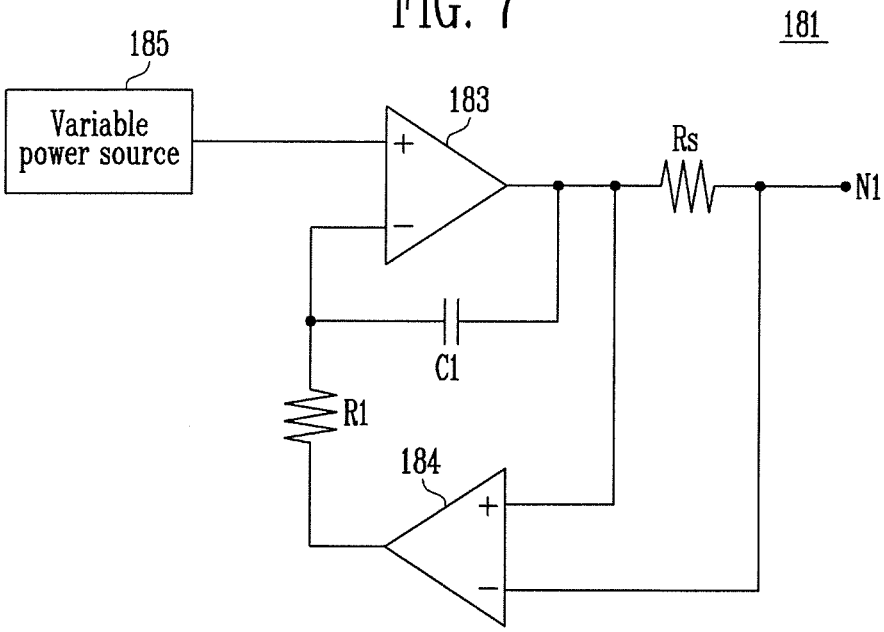
FIG. 7 is a view illustrating another embodiment of the current generator of FIG. 4.

On the other hand, as illustrated in FIG. 7, the current generator 181 according to another embodiment the present invention may further include a first resistor R1 coupled between the second input terminal (−) of the first amplifier 183 and the output terminal of the second amplifier 184 and a first capacitor C1 coupled between the second input terminal (−) and the output terminal of the first amplifier 183. The first resistor R1 and the first capacitor C1 may prevent the first amplifier 183 from oscillating to secure or improve stability.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A current generator comprising:

a variable power source;

a first amplifier having a first input terminal coupled to the variable power source;

a sensing resistor having a first end and a second end, the first end being directly coupled to an output terminal of the first amplifier, and the second end being directly coupled to an external terminal of the current generator; and a second amplifier having a first input terminal and a second input terminal directly coupled to respective ends of the sensing resistor and an output terminal coupled to a second input terminal of the first amplifier.

2. The current generator as claimed in claim 1, wherein the variable power source is configured to vary its output to a positive or negative voltage to supply a current to the external terminal via the sensing resistor or to sink a current from the external terminal.

3. The current generator as claimed in claim 1, wherein the first input terminals are positive input terminals, and wherein the second input terminals are negative input terminals.

4. The current generator as claimed in claim 1, wherein the first input terminal of the second amplifier is coupled between the sensing resistor and the output terminal of the first amplifier, and wherein the second input terminal of the second amplifier is coupled between the sensing resistor and the external terminal.

5. The current generator as claimed in claim 1, further comprising:

a first resistor coupled between the second input terminal of the first amplifier and the output terminal of the second amplifier; and a first capacitor coupled between the second input terminal of the first amplifier and the output terminal of the first amplifier.

6. An organic light emitting display comprising:

a pixel;

a current generator for supplying a first current to the pixel or for sinking a second current from the pixel;

an analog-to-digital converter (ADC) for converting a first voltage applied to the ADC when the first current is supplied via an organic light emitting diode (OLED) included in the pixel into a first digital value and for converting a second voltage applied to the ADC when the second current sinks via a driving transistor included in the pixel into a second digital value;

a memory for storing the first digital value and the second digital value;

a converting circuit for converting input data into corrected data in accordance with the first digital value and the second digital value stored in the memory; and a data driver for generating a data signal in accordance with the corrected data and for supplying the data signal to the pixel, wherein the current generator comprises:

a variable power source;

a first amplifier having a first input terminal coupled to the variable power source;

a sensing resistor having a first end and a second end, the first end being directly coupled to a node, and the second end being directly coupled to an output terminal of the first amplifier, the node being between the analog-to-digital converter and the pixel; and a second amplifier having a first input terminal and a second input terminal coupled to respective ends of the sensing resistor and an output terminal coupled to a second input terminal of the first amplifier.

7. The organic light emitting display as claimed in claim 6, wherein the corrected data is set to compensate for a deterioration of the OLED and a threshold voltage and mobility of the driving transistor.

8. The organic light emitting display as claimed in claim 6, wherein the variable power source is configured to vary its output to a positive or negative voltage in order to supply the first current to the pixel via the sensing resistor or to sink the second current from the pixel.

9. The organic light emitting display as claimed in claim 6, wherein the first input terminals are positive input terminals, and wherein the second input terminals are negative input terminals.

10. The organic light emitting display as claimed in claim 6, wherein the first input terminal of the second amplifier is coupled between the sensing resistor and the output terminal of the first amplifier, and wherein the second input terminal of the second amplifier is coupled between the sensing resistor and the node.

11. The organic light emitting display as claimed in claim 6, further comprising:

a first resistor coupled between the second input terminal of the first amplifier and the output terminal of the second amplifier; and a first capacitor coupled between the second input terminal of the first amplifier and the output terminal of the first amplifier.

12. The organic light emitting display as claimed in claim 6, further comprising:

a first switching element provided in a channel and positioned between the data driver and the pixel; and a second switching element provided in said channel and positioned between the node and the pixel.

* * * * *